US007562499B2

(12) United States Patent
Hillman

(10) Patent No.: US 7,562,499 B2
(45) Date of Patent: Jul. 21, 2009

(54) HYBRID COMPOSITE BEAM SYSTEM

(75) Inventor: John R. Hillman, Wilmette, IL (US)

(73) Assignee: HC Bridge Company, LLC, Wilmette, IL (US)

( * ) Notice: Subject to any disclaimer, the term of this patent is extended or adjusted under 35 U.S.C. 154(b) by 379 days.

(21) Appl. No.: 11/332,794

(22) Filed: Jan. 13, 2006

(65) Prior Publication Data

US 2007/0175165 A1 Aug. 2, 2007

(51) Int. Cl.
*E04C 3/02* (2006.01)

(52) U.S. Cl. ..... 52/223.8; 52/607; 52/834

(58) Field of Classification Search ..... 52/223.8, 52/223.11, 220.1, 649.2, 650.1, 737.1, 737, 52/738.1, 309, 505, 607, 223.12, 223.13, 52/223.14, 334, 421.1, 724.2, 724.1, 848, 52/FOR. 11–115, 839, 834; 14/18, 20–22
See application file for complete search history.

(56) References Cited

U.S. PATENT DOCUMENTS 4,829,733 A * 5/1989 Long ..... 52/309.11
4,924,641 A * 5/1990 Gibbar, Jr. ..... 52/204.1
4,948,312 A * 8/1990 Jochum ..... 411/5
5,671,572 A * 9/1997 Siller-Franco ..... 52/223.8
5,830,399 A * 11/1998 Keith et al. ..... 264/253
6,145,270 A * 11/2000 Hillman ..... 52/731.1
6,308,478 B1 * 10/2001 Kintscher et al. ..... 52/223.7
7,275,347 B2 * 10/2007 Hayes ..... 52/223.13
7,287,358 B2 * 10/2007 Zambelli et al. ..... 52/649.2
2002/0178665 A1 * 12/2002 Campbell ..... 52/223.13
2003/0037497 A1 * 2/2003 Kirby ..... 52/302.1
2003/0182883 A1 * 10/2003 Won ..... 52/223.8

* cited by examiner

*Primary Examiner*—Robert J Canfield
*Assistant Examiner*—James J Buckle, Jr.
(74) *Attorney, Agent, or Firm*—Ice Miller LLP

(57) ABSTRACT

A construction beam useful for building bridges, commercial or industrial buildings, or the like has an elongated shell with an interior volume. A conduit lies within the interior volume of the beam that has profile extending along a longitudinal direction of the beam. A compression reinforcement fills the interior volume of the conduit. The beam may include a shear connection device, where one end of the shear connection device is positioned in the compression reinforcement, and the other end extends outwardly through the shell.

9 Claims, 11 Drawing Sheets

HYBRID COMPOSITE BEAM SYSTEM

FIELD OF THE INVENTION

This invention relates generally to bridge structures and building structures designed for pedestrian and/or vehicular traffic and more specifically to commercial and industrial framed building construction and short to medium span bridges.

BACKGROUND OF THE INVENTION

Many or most of the short-span bridge structures in the United States are constructed of a deck surface on top of a supporting structure, most commonly a framework of steel or prestressed concrete I-beams. For example, a conventional two-span bridge (a total span of 140 feet) could have a three-inch pavement-wearing surface on a seven-inch structural slab of reinforced concrete supported on top of a framing system consisting of five longitudinal thirty-six inch steel wide flange beams or five longitudinal forty-five inch type IV AASHTO prestressed concrete girders.

There is believed to be a significant need in the United States for a structural beam for use in the framework of a bridge that provides greater resistance to corrosion through the use of plastic, and that can be built not only at a competitive cost, but also with a reduction in the self weight of the structural members as it relates to transportation and erection costs. Of course plastic can also refer to fiber reinforced plastic.

It has been known that fabrication of structural elements from fiber reinforced plastics results in a structure that is less susceptible to deterioration stemming from exposure to corrosive environments. One type of structural framing member is currently manufactured using the pultrusion process. In this process, unidirectional fibers (typically glass) are pulled continuously through a metal die where they are encompassed by a multidirectional glass fabric and fused together with a thermosetting resin matrix such as vinyl ester.

Although the composite structural members offer enhanced corrosion resistance, it is well known that structural shapes utilizing glass fibers have a very low elastic modulus compared to steel and very high material costs relative to both concrete and steel. As a result, pultruded structural beams consisting entirely of fiber reinforced plastic may not be cost effective to design and fabricate to meet the serviceability requirements, i.e. live load deflection criteria, currently mandated in the design codes for buildings and bridges.

SUMMARY

A construction beam useful for building bridges, commercial or industrial buildings, or the like is provided having an elongated shell with an interior volume. A conduit lies within the interior volume of the beam that has profile extending along a longitudinal direction of the beam. A compression reinforcement fills the interior volume of the conduit. The beam may include a shear connection device, where one end of the shear connection device is positioned in the compression reinforcement, and the other end extends outwardly through the shell.

The first end of the body of the shear connection device may be threaded. The shear connection device may include an anchoring device coupled to the second end of the body. The body may include a rod, and an anchoring device may be coupled to the rod. Additionally, the shear connection device may include a threaded rod, an anchoring device and a bolt, and the anchoring device may be coupled to the threaded rod by the bolt. Alternatively, the shear connection device may comprise a prefabricated fiber reinforced plastic.

In one embodiment, the beam may include an auxiliary conduit within the interior volume of the shell. The auxiliary conduit may extend along a lateral direction of the beam. A compression reinforcement may fill the interior volume of the auxiliary conduit. The auxiliary conduit may be in fluid communication with the conduit.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

Further advantages of the invention will become apparent upon reading the following detailed description of the invention in conjunction with the accompanying drawings, in which.

DETAILED DESCRIPTION OF THE PRESENTLY PREFERRED EMBODIMENTS

Figure 1:
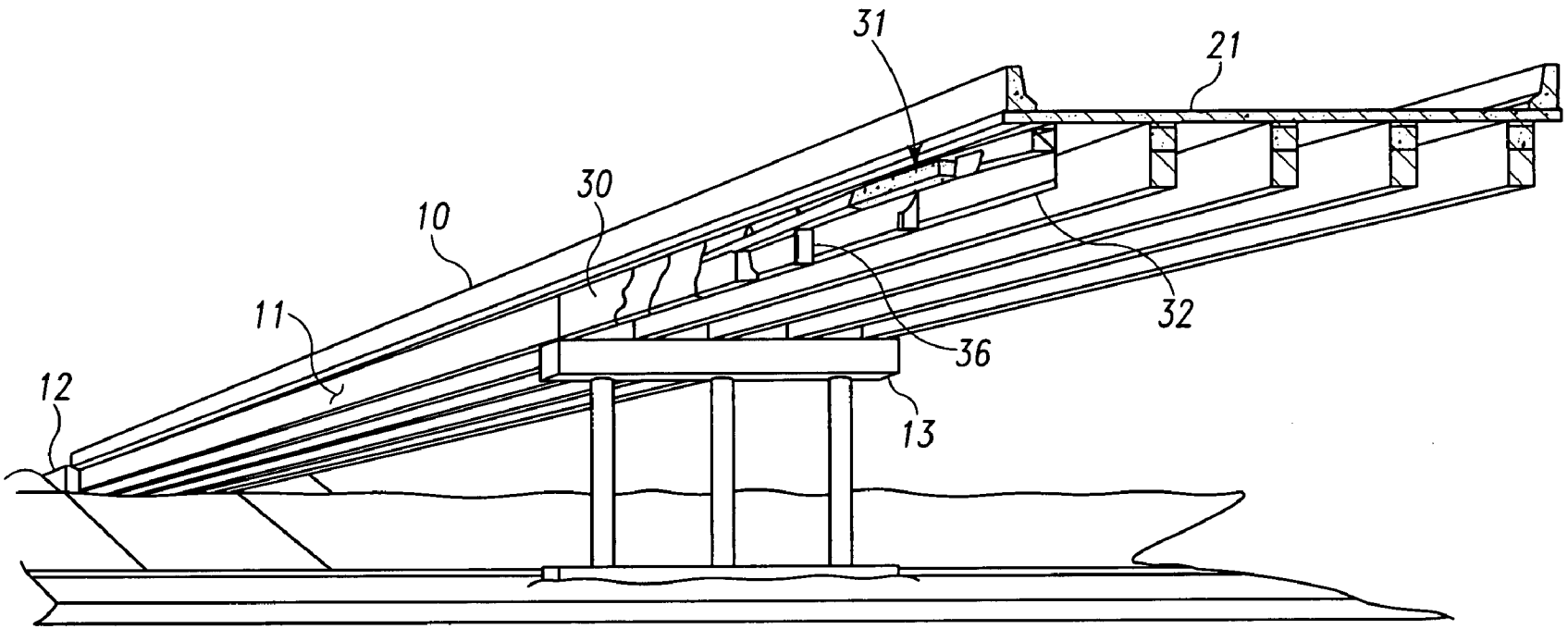
FIG. 1 is a fragmentary perspective of a first embodiment of a bridge constructed using composite beams.
Figure 2:
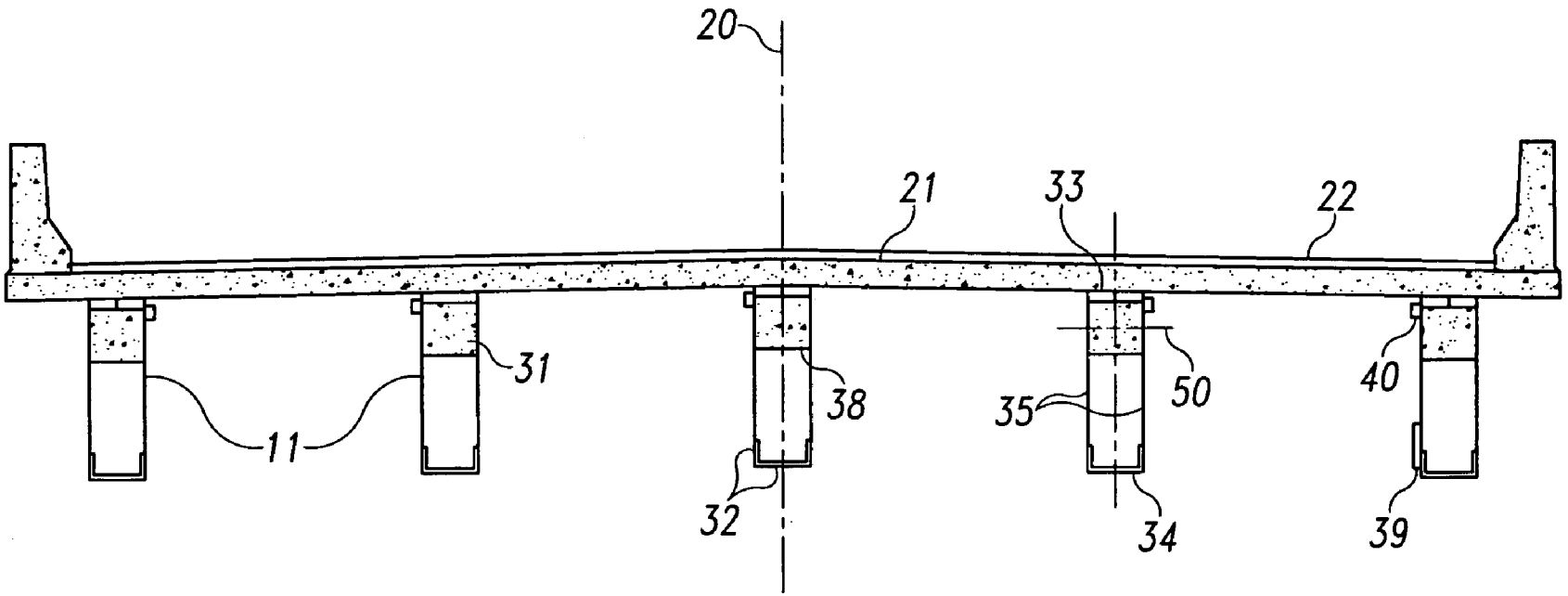
FIG. 2 is a typical cross-sectional view of the bridge shown in FIG. 1.

FIG. 1 shows an illustrative embodiment of a bridge 10. The illustrative bridge 10 is constructed using five rows of composite beams 11 spanning between bridge abutments 12 and over a central pier 13. These composite beams 11 may be spaced at about seven-feet, six-inch intervals transversely in a symmetrical arrangement about a centerline 20 of the bridge as shown in FIG. 2. The out-to-out width of the illustrative bridge 10 is shown as about thirty-five feet, but could be wider or narrower. For embodiments where the bridge 10 is wider or narrower, the number of composite beams 11 and spacing of the beams 11 within the cross-section may vary.

The illustrative bridge 10 comprises two spans of about seventy feet, and has two composite beams 11 per row. In an alternative embodiment, the illustrative bridge 10 could have more or fewer spans, and the spans could be longer or shorter. Each composite beam 11 in a row may simply be supported between an abutment 12 and the central pier 13. In another embodiment, two or more girders in one row could be made continuous over the supports. For bridges with more than two spans, the composite beams 11 could be supported between two adjacent piers 13. The deck surface may include deck slab 21 covered by, but not necessarily requiring, an overlying wearing pavement 22. In one embodiment, the deck slab 21 may be a reinforced concrete deck slab. The deck may be constructed out of materials other than reinforced concrete, such as, for example, a fiber reinforced plastic deck.

Figure 3:
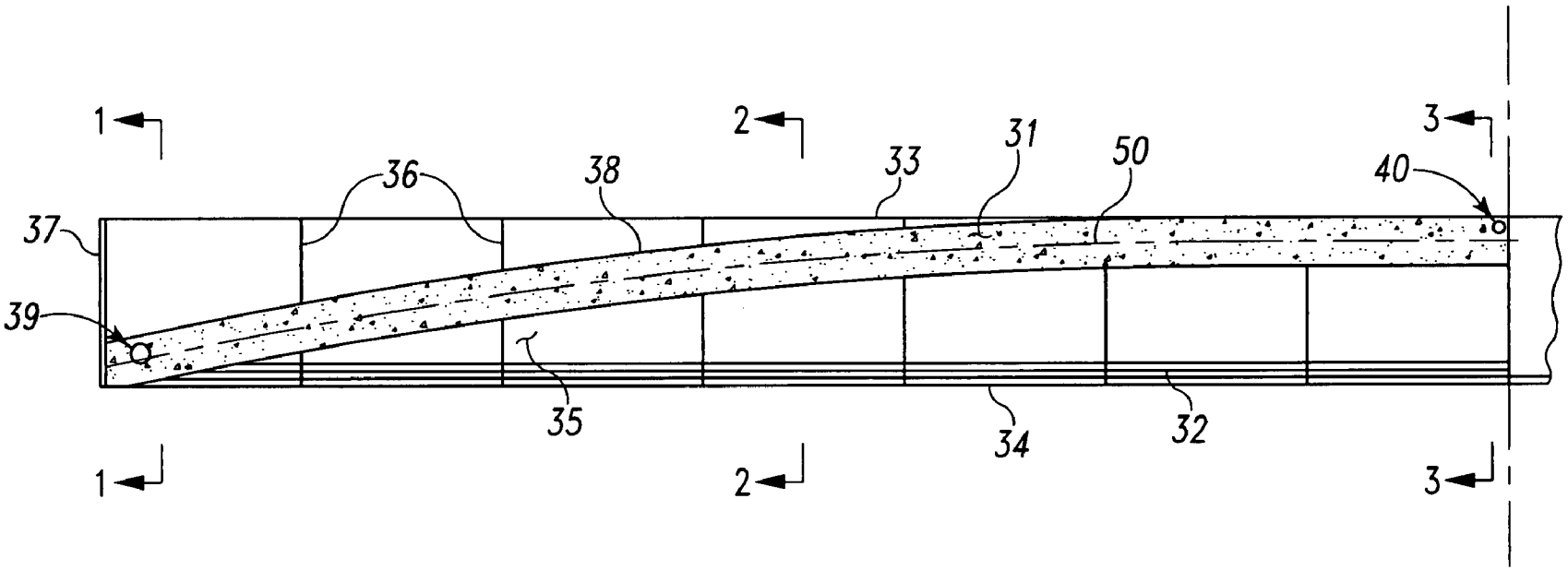
FIG. 3 is a side view of a first embodiment of a composite beam of the bridge shown in FIG. 1.

The composite beams 11 shown in FIG. 1 may include a plastic beam shell 30, a compression reinforcement 31, and a tension reinforcement 32. In one embodiment, the composite beam 11 may also include a core material 44, as shown in FIGS. 4-7, and elsewhere. The composite beam 11 could be fabricated to a variety of widths and heights and may also be constructed with the width and or height varying over the length of the beam 11. In the illustrative embodiment of the beam 11 shown in FIGS. 1-3, the beam 11 has a constant height of forty-seven inches and a constant width of sixteen inches. The height of the composite beams 11 in the bridge 10 illustrated in FIG. 1 may result in a span to depth ratio of approximately 18:1, but could be altered to provide different span to depth ratios while still remaining within the scope of the attached claims.

The beam shell 30 of the composite beam 11 may be constructed of a vinyl ester resin reinforced by glass fibers optimally oriented to resist the anticipated forces in the beam 11. The beam 11 may also be constructed using other types of plastic resins, other types of resins, or other types of plastics. The beam shell 30 may include a top flange 33, a bottom flange 34, intermediate vertical stiffeners 36, and two end stiffeners 37. The beam shell 30 may also include a continuous conduit 38, an injection port 39, and vent ports 40 to be used for the compression reinforcement 31. The beam shell 30 may further include a shear transfer medium 35 which serves to transfer applied loads to the composite beam 11, and to transfer the shear forces between the compression reinforcement 31 and tension reinforcement 32.

In one embodiment, the shear transfer medium 35 comprises two vertical webs, but may also include one single or multiple webs, or truss members interconnecting the top flange 33, bottom flange 34, compression reinforcement 31 and tension reinforcement 32. All of the components of the beam shell 30 may be fabricated monolithically using a vacuum assisted resin transfer method, or using other manufacturing processes.

Figure 4:
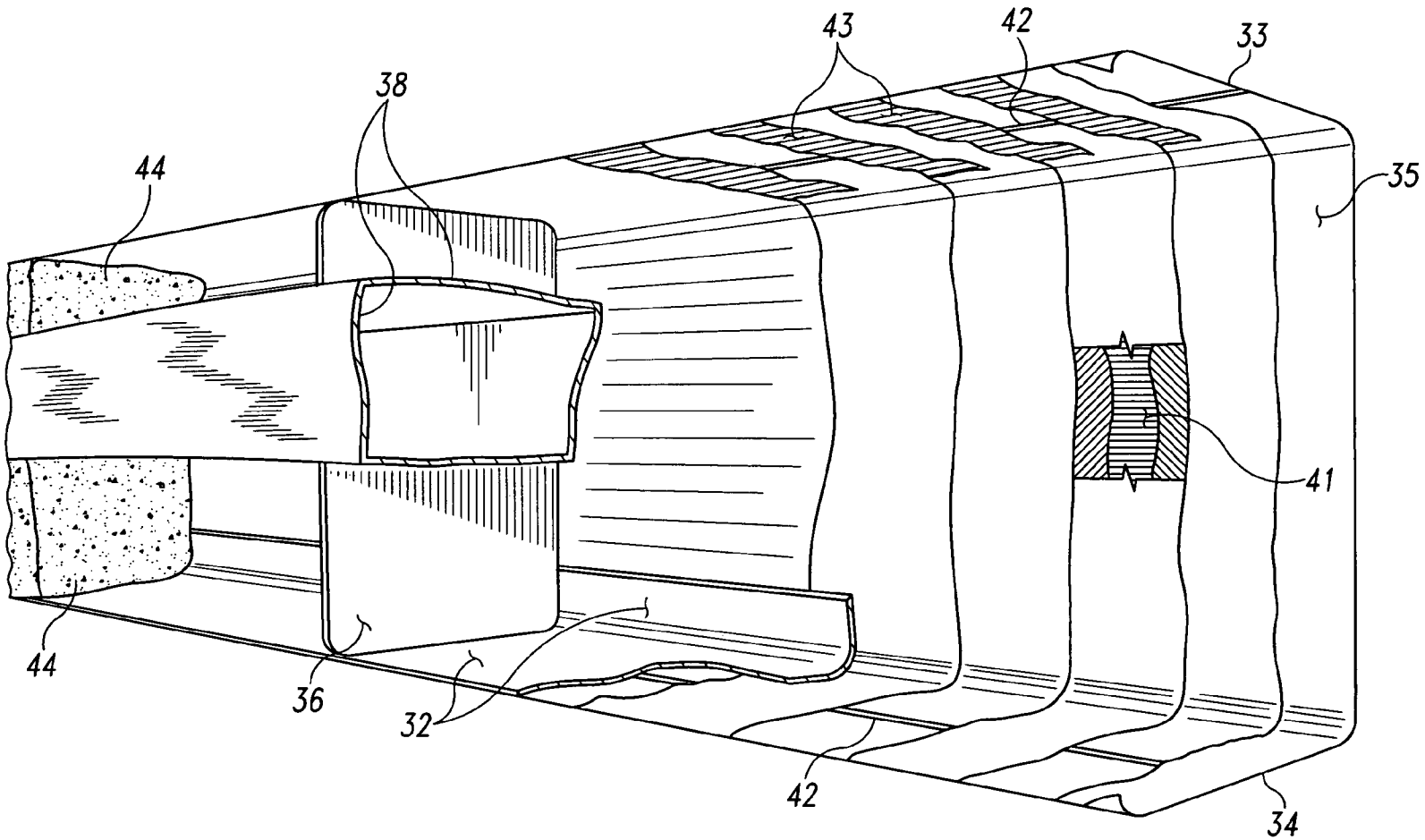
FIG. 4 is a fragmentary perspective of a composite beam.
Figure 7:
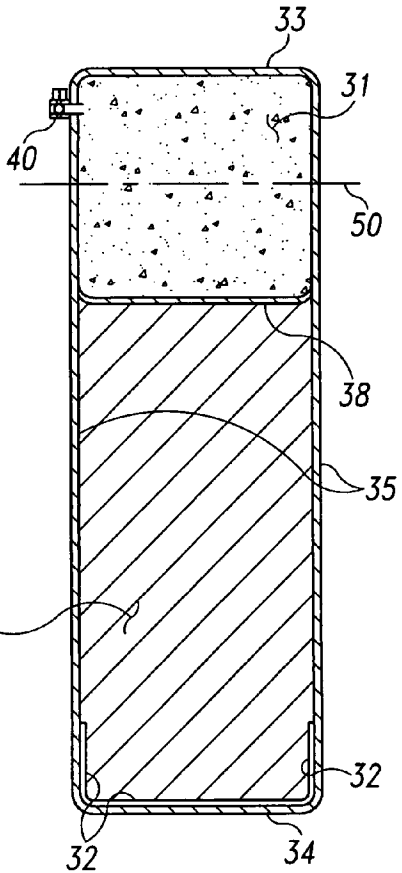
FIG. 7 is a partial sectional view taken through line 3-3 of FIG. 3.

As shown in FIG. 4, the core material 44 may be located above and below the continuous conduit 38, or may surround the continuous conduit 38. The core material 44 may be a low density foam, such as polyisocyanorate, polyurethane, polystyrene, some type of a starch such as wood or a synthetic or processed starch, or a fibrous material. The core material 44 may fill all or a portion of the void between the shell 30 and the continuous conduit 38. The core material 44 may act as an additional shear transfer element, or may serve to maintain the form of the beam 11 prior to resin injection and/or introduction of the compression reinforcement 31.

The shear transfer medium 35 of the beam shell 30 may be reinforced with six layers of fiberglass fabric 41 with a triaxial weave in which sixty-five percent of the fibers are oriented along the longitudinal axis of the beam 11 and the remaining thirty-five percent of the fibers are oriented with equal amounts in plus or minus forty-five degrees relative to the longitudinal axis of the beam 11. The fibers oriented at plus or minus forty-five degrees to the longitudinal axis may improve both the strength and stiffness as it relates to shear forces within the beam 11. The shear medium 35 may also be constructed with more or fewer layers of fiberglass reinforcing and with different dimensions, proportions or orientations of the fibers.

The layers of glass reinforcing fabric comprising the shear transfer medium of the beam shell 30 may extend around the perimeter of the cross section such that they also become the reinforcement for the top flange 33, bottom flange 34 and vertical end stiffener 37 of the beam shell 30. The perimeter of the beam shell 30 is a rectangle with the corners rounded on a radius, but could be constructed using a different shape. All longitudinal seams 42 of the fiberglass fabrics used in the beam shell 30 may be located within the top and bottom flanges of the beam shell 30. The top flange 33 of the beam shell 30 may also contain four layers of unidirectional weave fiberglass fabric 43 located longitudinally between the layers of triaxial weave fabric 41 and which turn down at a ninety degree angle and help form the vertical end stiffener 37 of the beam shell 30.

Each beam shell 30 also contains intermediate vertical stiffeners 36, again consisting of glass fiber reinforced plastic. The vertical stiffeners 36, are shown spaced at about five-feet longitudinal intervals along the beam shell 30 in FIG. 3, but could be spaced at different intervals. The dimensions of the vertical stiffeners may be the same as the internal height and width of the beam shell 30. The reinforcing for the vertical stiffeners 36 comprises three layers of the same triaxial weave glass fabric 41 used for the webs comprising the shear transfer medium 35, except with the sixty-five percent layer of fibers oriented along a vertical plane, perpendicular to the longitudinal axis of the composite beam 11. The illustrative vertical stiffeners 36 shown in FIG. 4 are about 0.126 inch thick, but could be constructed of different thicknesses. The vertical stiffeners 36 may also be fabricated using reinforcing fabrics with different proportions, orientations or composition.

Figure 6:
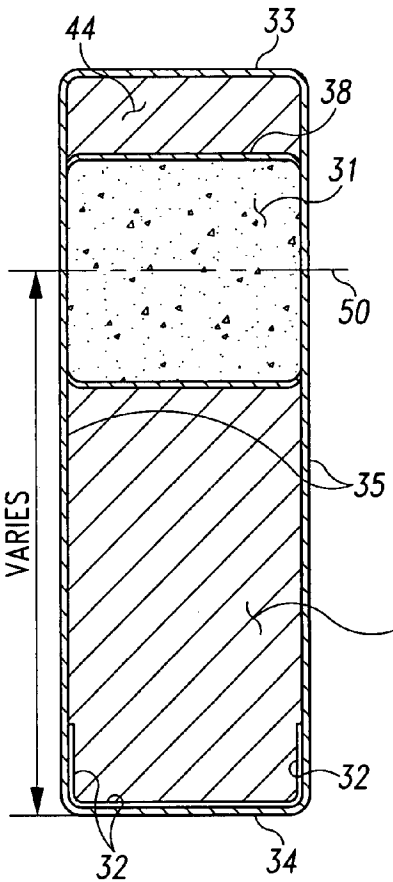
FIG. 6 is a partial sectional view taken through line 2-2 of FIG. 3.
Figure 5:
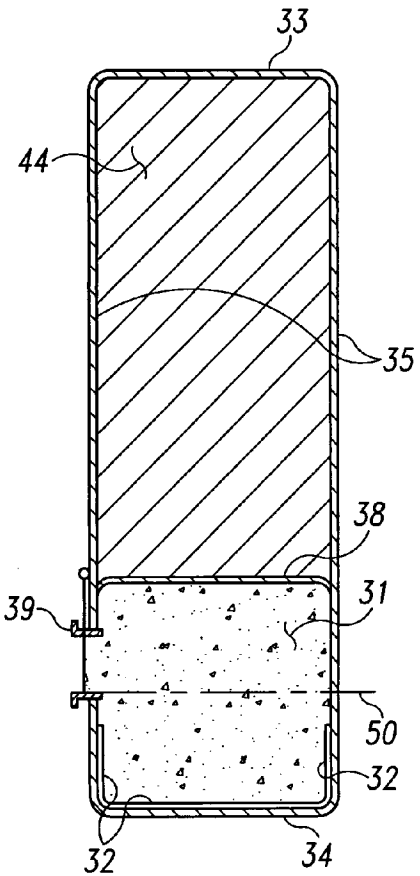
FIG. 5 is a partial sectional view taken through line 1-1 of FIG. 3.

The beam shell 30 may be fabricated with a conduit 38 which runs longitudinally and continuously between the ends of the beam 11 along a profile designed to accommodate the compression reinforcement 31, which is described later. The conduit 38 may comprise a continuous rectangular thin wall tube, or a rounded tube, or another shape of tube. The conduit 38 may be constructed of two layers of triaxial weave fiberglass fabric 41 as shown in FIG. 4. The conduit 38 passing through them interrupts the intermediate stiffeners 36 vertically, where the elevation of the interruption can be a function of the profile of the compression reinforcement 31. The conduit 38 may also contain an injection port 39 located along one web of the beam 11 as depicted in FIG. 5, to be used for the introduction of the compression reinforcement 31. Vent ports 40 are also located at the highest and lowest points along the profile of the conduit as shown in FIG. 6. Again the conduit 38 could be constructed using reinforcing fabrics with different proportions, orientations or compositions.

Each of the composite beams 11 includes compression reinforcement 31. The compression reinforcement 31 may comprise portland cement concrete, portland cement grout, polymer cement concrete or polymer concrete. In one embodiment, the compression reinforcement 31 comprises portland cement concrete with a compressive strength of 6,000 pounds per square inch. The compression reinforcement 31 may be introduced into the conduit 38 within the beam shell 30 by pumping it through the injection port 39 located in the side of the conduit 38. The vent ports 40 may prevent air from being trapped within the conduit 38 during the placement of the compression reinforcement 31.

The compression reinforcement 31 as shown in FIG. 6 has a rectangular cross section that is fifteen and one-half inches wide and fourteen and seven-tenths inches tall, but could be manufactured to larger or smaller dimensions. The profile 50 of the compression reinforcement 31 may follow a path that starts near the bottom of the beam 11 at the beam ends and curves upwards to the highest point on the profile located near the center of the beam 11, such that the conduit 38 is tangent to the top flange 33. In the illustrative embodiment shown in FIG. 3, the profile 50 of the compression reinforcement 31 follows a path which starts at approximately seven inches off of the bottom of the beam 11 at the beam ends and varies parabolically with the highest point on the profile located at the center of the beam 11 such that the conduit 38 is tangent to the top flange 33. The profile 50 of the compression reinforcement 31 may also follow other curved paths that start near the bottom of the beam 11 at the beam ends and curve upwards to a point near the center of the beam 11.

The profile 50 of the compression reinforcement 31 is designed to resist the compression and shear forces resulting from vertical loads applied to the beam 11 in much the same manner as an arch structure. The profile 50 of the compression reinforcement 31 could be constructed along a different geometric path and to different dimensions from those indicated. While the embodiment presented assumes introduction of the compression reinforcement 31 after the beam shell 30 has been erected, it could also be introduced during fabrication of the beam shell 30.

The thrust induced into the compression reinforcement 31 resulting from externally applied loads on the composite beam 11 is equilibrated by the tension reinforcement 32 of the composite beam 11. In one embodiment, the tension reinforcement 32 may comprise layers of unidirectional carbon reinforcing fibers with tensile strength of 160,000 pounds per square inch and an elastic modulus of 16,000,000 pounds per square inch. Although in one embodiment of the composite beam 11 utilizes carbon fibers, other fibers could also be used for the tension reinforcement 32 including glass, aramid, standard mild reinforcing steel or prestressing strand as is known in the art.

The fibers that are located just above the glass reinforcing of the bottom flange 34 and along the insides of the bottom 6 inches of the shear transfer medium 35 as illustrated in FIG. 4, may be oriented along the longitudinal axis of the composite beam 11. The fibers may also wrap around the compression reinforcement 31 at the ends of the beams 11. The tension reinforcement 32 can be fabricated monolithically into the composite beam 11 at the same time the beam shell 30 is constructed, but could also be installed by encasing conduits in the beam shell 30 which would allow installation at a later date, or by bonding the tension reinforcement 32 to the outside of the beam shell 30 after fabrication. Again, the quantity, composition, orientation and positioning of the fibers in the tension reinforcement 32 can be varied.

In one embodiment, all of the composite beams 11 within a span have the same physical geometry, composition and orientation. Benefits could also be obtained using composite beams 11 with different and or varying geometries. Use of composite beams 11 having the same physical geometry for the beam shell 30, however, may minimize tooling costs for fabrication due to economies of scale associated with repetition. Where several bridges are to be built, it may be possible to satisfy the load requirements of different bridges using composite beams 11 with the same geometry for the beam shell 30, by merely changing the dimensions or profile of the compression reinforcement 31 or the quantity and dimensions of the tension reinforcement 32.

Figure 8:
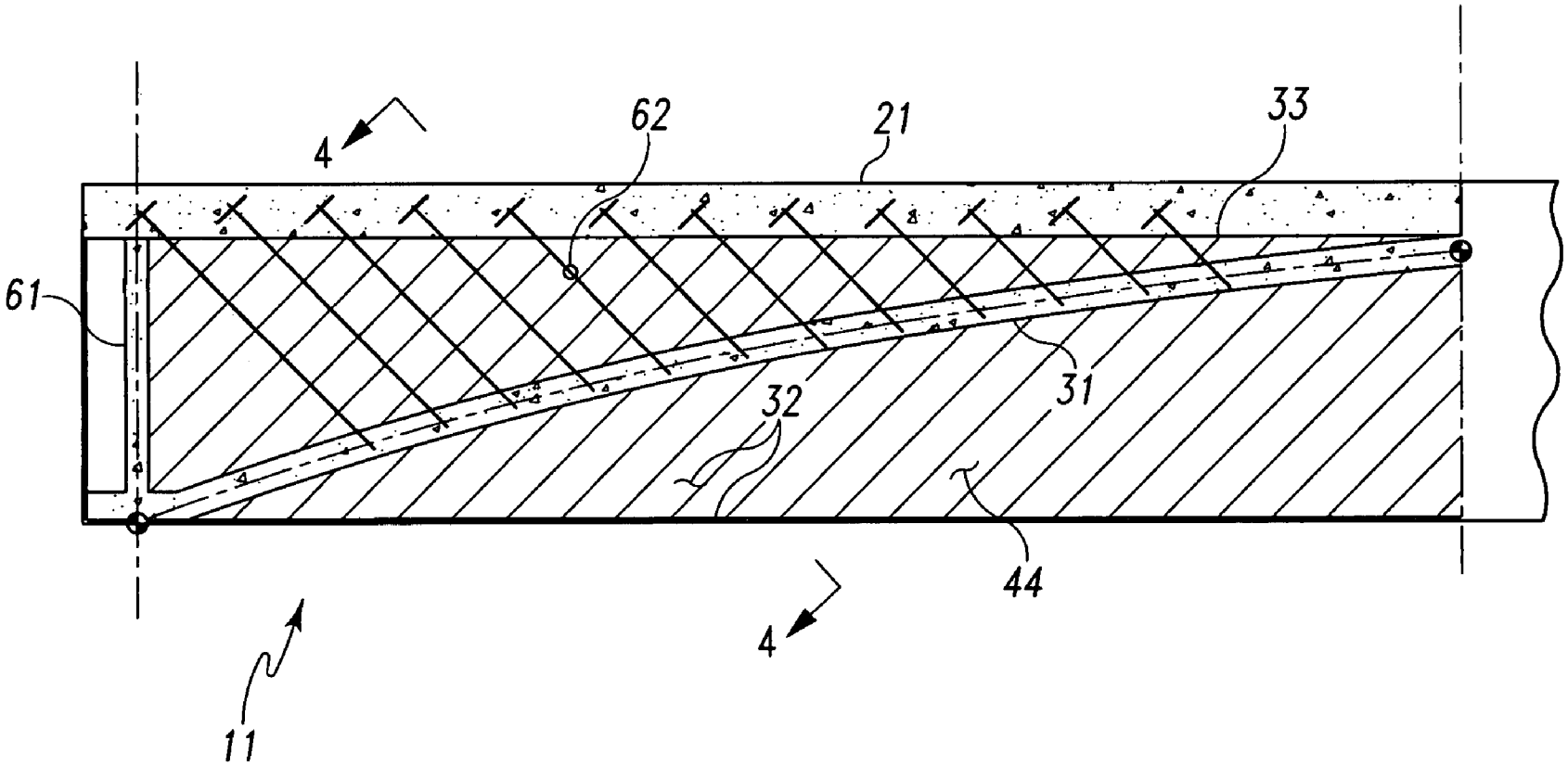
FIG. 8 is a side view of a second embodiment of the composite beam of the bridge shown in FIG. 1.
Figure 9:
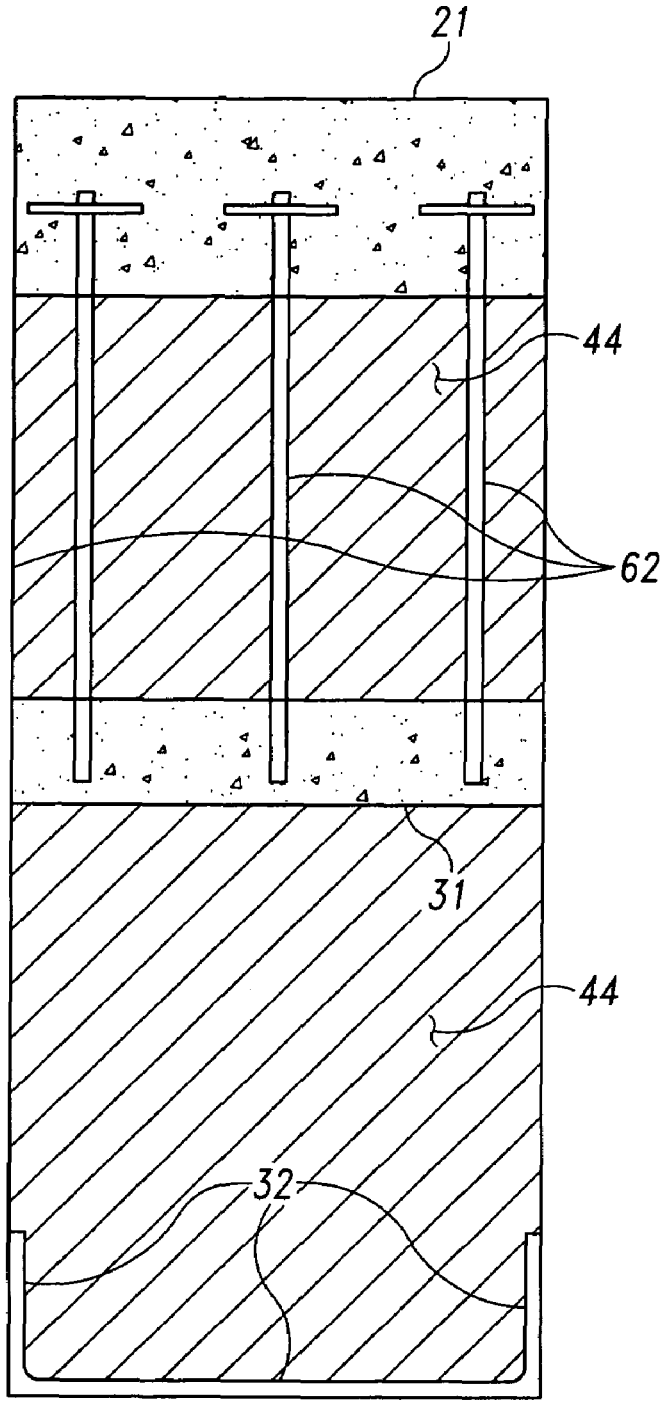
FIG. 9 is a partial sectional view taken through line 4-4 of FIG. 8.
Figure 10:
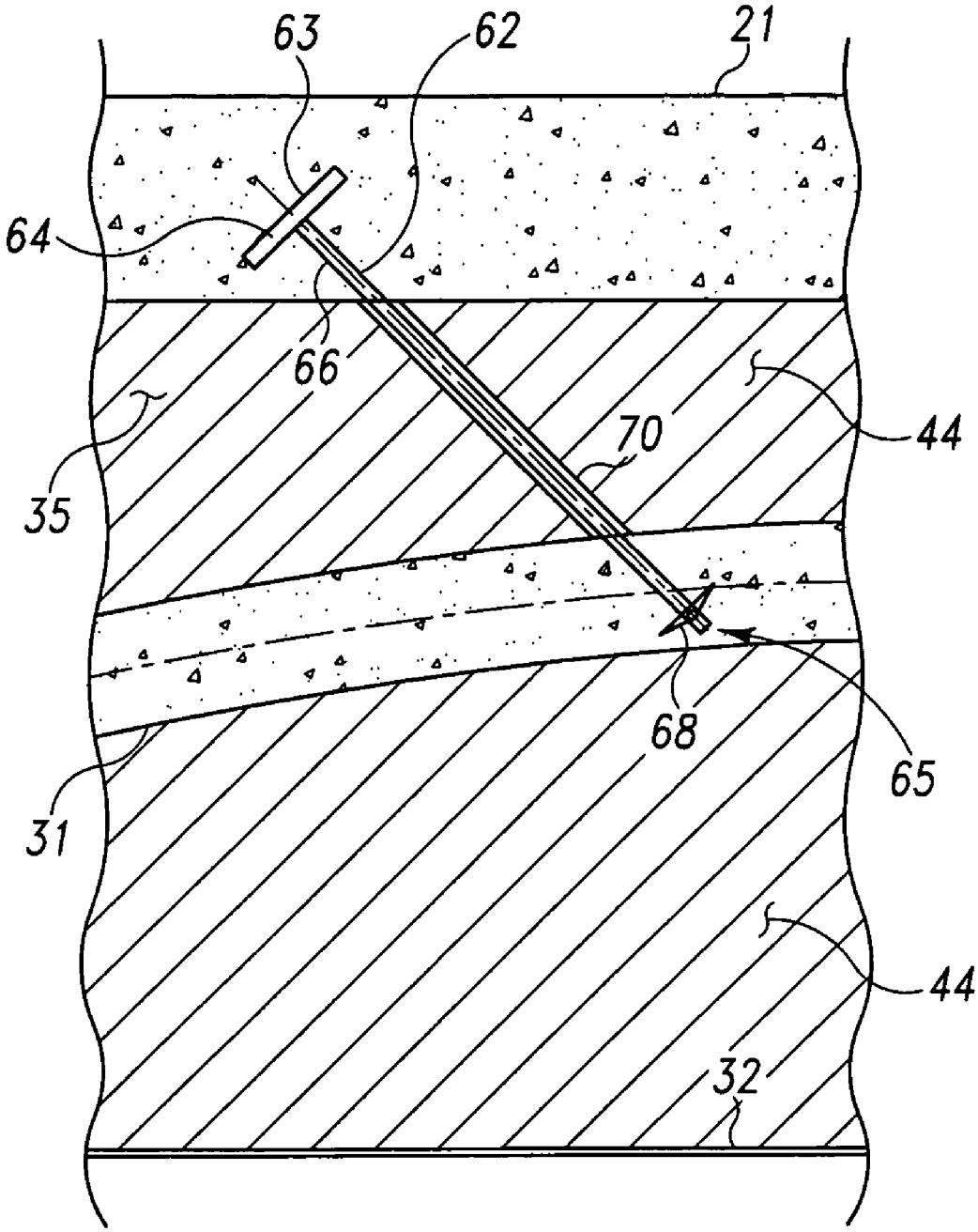
FIG. 10 is a side view of a first embodiment of a shear connection device of the beam of FIG. 8.
Figure 11:
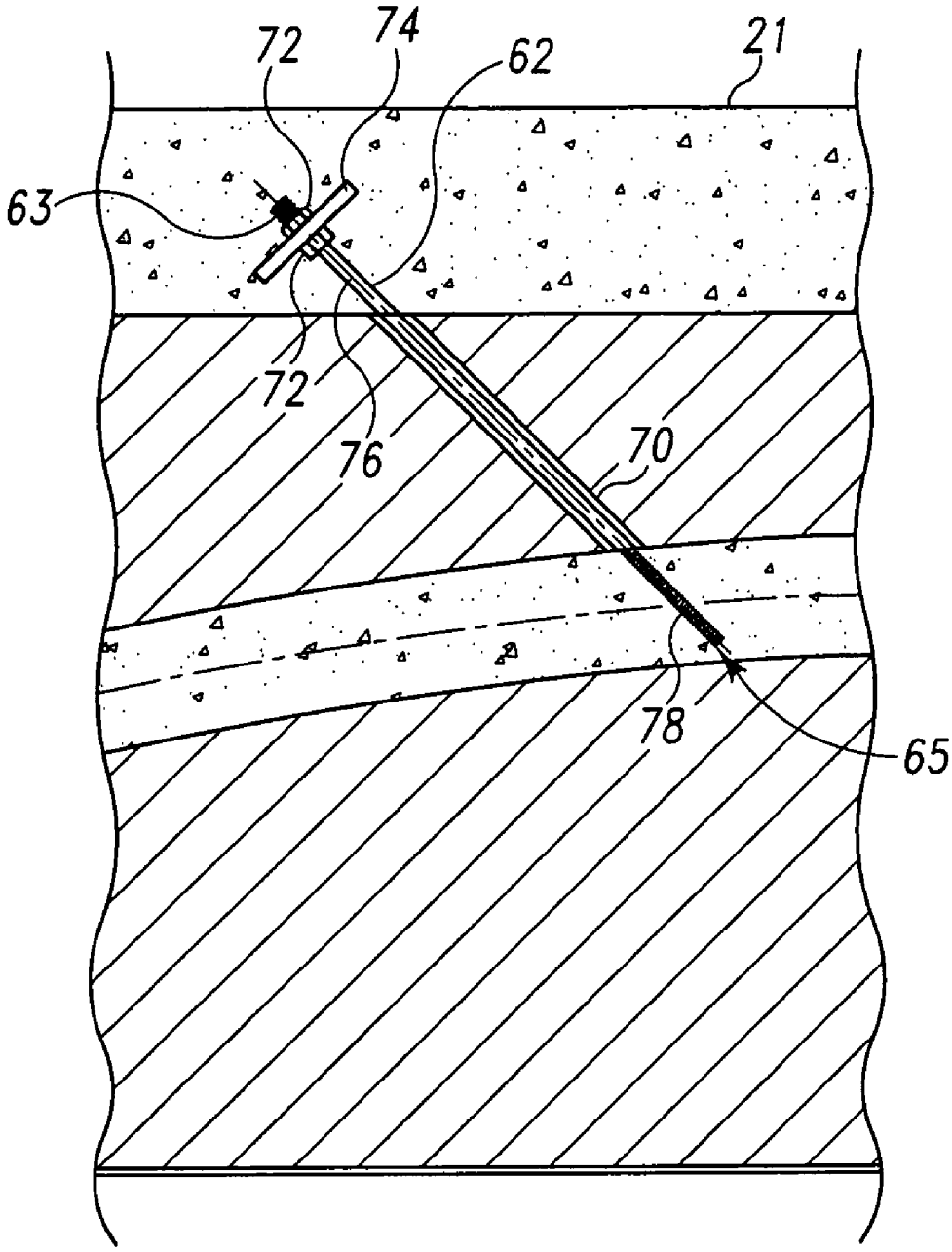
FIG. 11 is a side view of a second embodiment of a shear connection device of the beam of FIG. 8.
Figure 12:
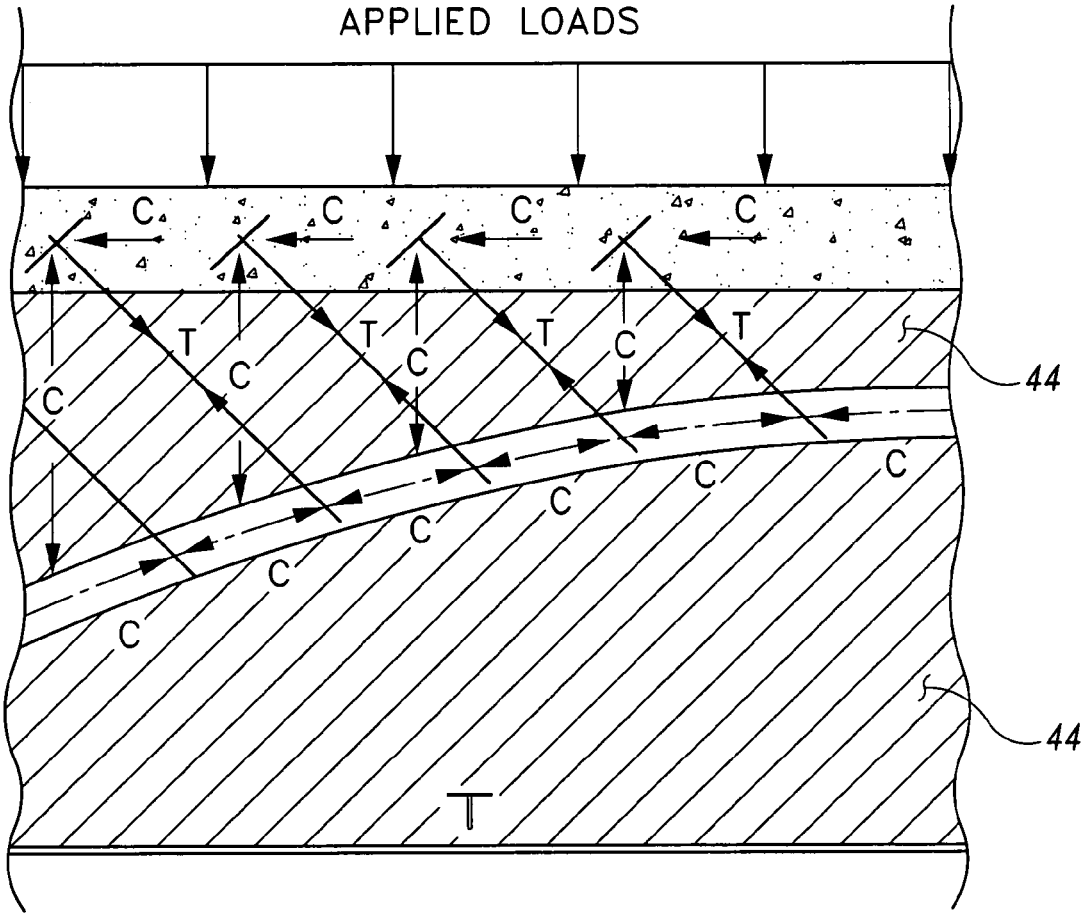
FIG. 12 is a loading diagram for a section of the beam of FIG. 8.

An embodiment of the beam 11 including a shear connection device 62 is shown in FIGS. 8-12. FIG. 8 is an elevation view of the beam 11 including the shear connection device 62. FIG. 9 is a cross section view of the beam 11 including the shear connection device 62 taken through line 4-4 of FIG. 8. FIG. 10 is a detailed view of a first embodiment of the shear connection device 62. FIG. 11 is a detailed view of a second embodiment of the shear connection device 62. FIG. 12 is a loading diagram showing forces in the beam 11, the shear connection devices 62, and the deck slab 21 resulting from an applied load. For clarity, the optional vertical stiffeners 36 are omitted from FIGS. 8-12, so that the shear connection devices 62 may be shown more clearly. It should be understood that the vertical stiffeners 36 may or may not be included in the embodiment of the beam 11 described in FIGS. 8-12.

As shown in FIGS. 8 and 9, the beam 11 may comprise at least one shear connection device 62. FIGS. 8 and 9 also show one method of illustrative positioning for a plurality of the shear connection devices 62 relative to a beam 11. The shear connection device 62 employed between the beam 11 and the deck slab 21 may provide two distinct advantages. First, the shear connection device 62 may provide a positive means of connection between the beam 11 and the deck slab 21, and thereby prevent any slippage or displacement of the deck slab 21 relative to the beam 11. Second, the shear connection device 62 may resist the horizontal shear forces between the top flange 33 of the beam 11 and the deck slab 21, thereby allowing the two to act together as a single composite structural component to resist applied loads. Thus, the shear connection device 62 may facilitate composite structural behavior between the composite beam 11 and deck slab 21 and/or the overlying wearing pavement 22.

Various methods for installing and anchoring the shear connection device 62 to the beam 11 and/or deck slab 21 will now be described. In a first installation method (not shown), the shear connection device 62 may be attached to the top flange 33 of the beam 11 using a mechanical fastener or an adhesive, or fabricated into the top flange 33. This method results in the transfer of shear forces through the webs of the beam 11.

In a second installation method, shown in FIGS. 8-11, the shear connection devices 62 may be installed through holes 70 formed through the top of the shell 30 of the beam 11, and through a wall of the conduit 38. In embodiments where the beam 11 includes the core material 44, the holes 70 likewise are formed in the core material 44 that fills a portion of the interior volume of the beam shell 30, as shown. The shear connection device 62 may then be anchored into the beam 11 by allowing a first end 65 to extend into the profiled conduit 38 prior to the introduction of the compression reinforcement 31 into the profiled conduit 38. Later, for example at the construction site of the bridge 10, the compression reinforcement 31 may be placed and cured, such that the shear connection device 62 will be rigidly attached to the beam 11. Alternatively, the compression reinforcement 31 may be placed and cured at a manufacturing site.

A second end 63 of the shear connection device 62 may be allowed to protrude through the top of the beam 11. The shear connection device 62 may contain an anchoring device near the end 63. For example, the anchoring device may be rigidly attached to the shear connection device 62 near the end 63. The anchoring device may comprise a square plate or large washer, as described below and shown in FIGS. 10 and 11. Of course, this anchoring device could take on many other forms as well, and could be round, square, rectangular, star-shaped, octagonal, hexagonal, pentagonal, or have the form of almost any conceivable polygon.

Various embodiments of the shear connection device 62 having many different forms are envisioned and within the scope of the claims attached to this disclosure. In one embodiment, the shear connection device 62 may comprise a body 76. For example, the body 76 may comprise a threaded rod inserted into the beam 11, as shown in FIG. 11. The threads 78 on the rod may provide for the shear interface with the compression reinforcement 31 to develop the tension force in the shear connection device 62. The top portion 63 of the embodiment of the shear connection device 62 shown in FIG. 11 may include an anchoring device comprising a plate 74. For example, the plate 74 having a thickness of between about one-quarter inch and one-half inch thick, with a hole cut through the plate 74, preferably near the center. The plate may be attached to the threaded rod by bolts 72 screwed on to the threaded rod on either side of the plate 74. In other embodiments, the plate 74 could also be welded or cast on to the body 76 of the shear connection device 62. The plate 74 and the body 76 may comprise a metal, such as steel, iron, aluminum, nickel, copper, or a metallic alloy. The plate 74 and the body 76 may also comprise a composite material, such as glass, fiberglass, carbon, steel, or a mixture of these or other materials.

In another embodiment, the shear connection device 62 may comprise a prefabricated fiber reinforced plastic (FRP) member with very similar geometry to the embodiment of the shear connection device 62 described above. There may be benefits to using an FRP shear connector, such as limiting corrosion and degradation over time due to oxidation, as may occur with a metallic construction.

As shown in FIG. 10, in another embodiment the shear connection device 62 may comprise a body 66 and an end 65 having an expandable appendage 68 that expands as the shear connection device 62 is inserted into the profiled conduit 38, in a similar manner to the operation of a toggle bolt. The appendage 68 shown in FIG. 10 may allow for further development of the shear connection device 62 anchorage into the compression reinforcement. The top portion 63 of the embodiment of the shear connection device 62 shown in FIG. 10 may also include an anchoring device comprising a plate 64. For example, the plate 64 may be attached to the body 66 (which may comprise a rod) by bolts, or may be welded or cast on to the body 66 of the shear connection device 62 near the top portion 63. The plate 64 and the body 66 may comprise a metal, such as steel, iron, aluminum, nickel, copper, or a metallic alloy. The plate 64 and the body 66 may also comprise a composite material, such as glass, fiberglass, carbon, steel, FRP, or a mixture of these or other materials.

As shown by the load diagram in FIG. 12, one benefit of the anchoring devices of the shear connection device 62 is a transfer in tension, of the compression forces developed in the deck slab 21 during bending, through the shear connection device 62 to the compression reinforcement 31. In FIG. 12, T represents tension force and C represents compression force. The tension force introduced into the shear connection device 62 and the compression forces in the deck slab 21 are equilibrated by a vertical force that is directed into the core material 44 between the top flange 33 of the beam 11 and the compression reinforcement 32.

As shown in FIGS. 8-12, the shear connection device 62 may be installed on an angle of approximately forth-five degrees; however, in various embodiments this angle may be larger or smaller. The intent is to angle the shear connection device 62 in a direction extending towards the point in the beam 11 that has zero shear force from applied loads. The efficiency of the shear connection device 62 in equilibrating forces may be dependent on its the angle of inclination.

One feature of the embodiment of the beam 11 shown in shown in FIGS. 8-12 may be auxiliary conduits 61 formed in the core material 44 during construction of the beam 11. Although described and shown having a vertical orientation in the exemplary embodiment shown in FIG. 8, the auxiliary conduits 61 may be oriented in any direction. The auxiliary conduits 61 can later be filled with a material similar to that used for the compression reinforcement, similarly to the manner by which the profiled conduit 38 is filled. Once filled, these auxiliary conduits 61 can serve various distinct purposes. In one example shown in FIG. 8, one or more cylindrical auxiliary conduits 61 are oriented in a vertical position at the centerlines of bearing of the beam 11. (Because only half of the beam 11 is shown in FIG. 8, only one centerline of bearing is shown, and only half of the cylindrical auxiliary conduits 61 are shown.) In this exemplary embodiment, once the auxiliary conduits 61 are filled with compression reinforcement material, they serve as bearing stiffeners at the ends of the beam 11. In another example, similar auxiliary conduits 61 could also be introduced at other discreet locations along the beam 11. For example, auxiliary conduits 61 could also be introduced directly under the anchoring devices of the shear connection device 62. Additionally, the auxiliary conduits 61 can also be filled with compression reinforcement material and serve as a load path to transfer the auxiliary component of bearing stress in lieu of the shear transfer medium 35, or the core material 44.

Additionally, the auxiliary conduits 61 may serve as a location to attach an injection hose or tube to facilitate pumping the compression reinforcement material into the interior volume of the beam 11. By using the auxiliary conduits 61 for this purpose, it may possible to inject the compression reinforcement material into a beam from the lowest point on the profiled conduit 38, while providing a vent at the highest point on the profiled conduit 38, in order to help ensure that no air is trapped in the compression reinforcement material. The auxiliary conduits 61 may also serve as a location to insert a threaded rod or a lifting hook, which can provide a means for lifting the beam 11 for erection during construction of the bridge 10.

Fabrication of these auxiliary conduits 11 into the beam 11 may be accomplished as follows. Prior to infusion of a beam 11 with the compression reinforcement material, the auxiliary conduits 61 may be created by removing a volume of the shear transfer medium 35 from the desired location by cutting or drilling the core material 44. A bagging material or a flexible bladder, which may be fabricated from latex, can be placed in the space created in the core material 44. A hole may also be provided in the beam 11 mold, such that the bagging material or bladder can extend through the hole and remain impermeable on the inside of the mold, but open to the atmosphere on the outside of the mold. As such, said bladder would remain open to atmospheric pressure during infusion of the beam 11 during the introduction of the resin into the beam 11. Vacuum pressure may be applied to the mold that will expand and compress the bagging material or bladder against the core material 44 inside the beam 11, thereby preventing the resin from filling this interior volume during infusion of the beam 11. Subsequent to the infusion of the beam 11 with the resin, the bagging material or bladder can simply be removed resulting in the desired conduit. The general process for creating a composite structure using a resin are known to those of skill in the art.

Figure 13:
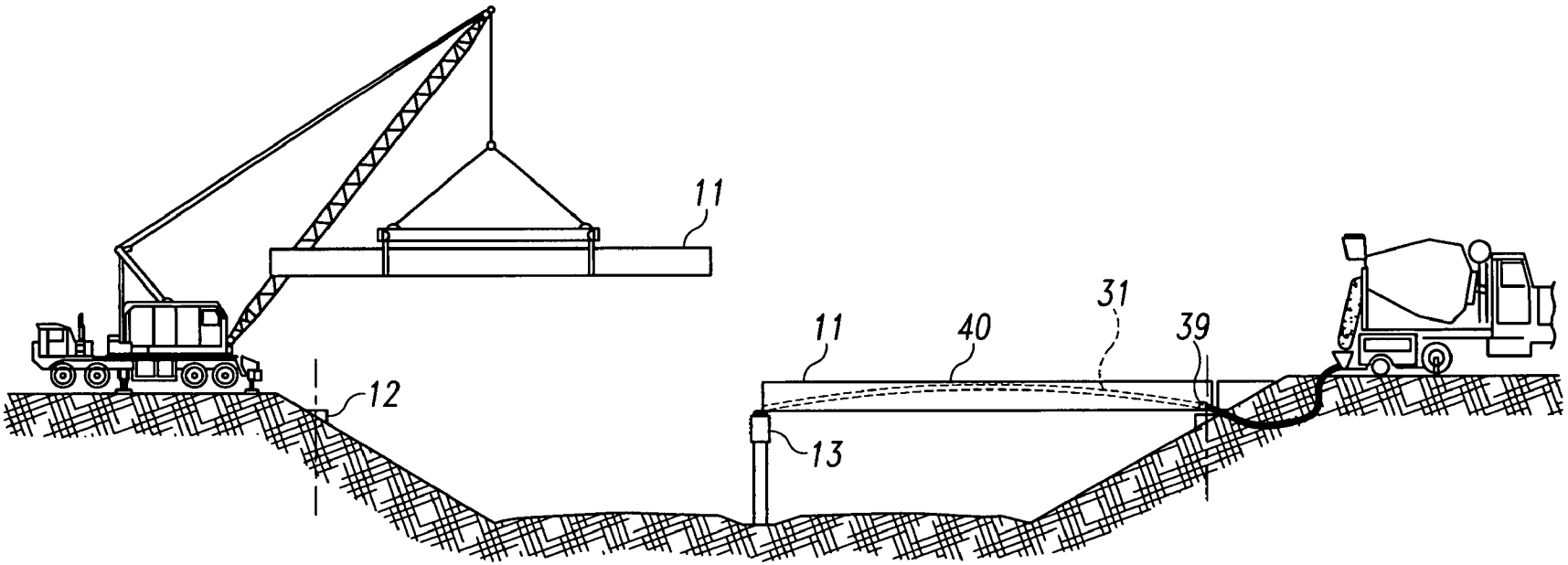
FIG. 13 is a diagrammatic view showing composite beams being placed on the substructure for the bridge shown in FIG. 1.

The illustrative bridge 10 can be built quickly and easily, as shown in FIG. 13. The composite beams 11 may be erected prior to injection of the compression reinforcement 31 by placing them with a crane, as is standard in the art. The composite beams 11 can be self supporting prior to and during the installation of the compression reinforcement 31. In the case of bridge replacement or rehabilitation, it may be possible to reuse existing abutments and/or intermediate piers. The compression reinforcement 31 may then be introduced into the composite beam 11 by injecting a compression reinforcement material into the profiled conduit 38 in the beam shell 30. The compression reinforcement 31 may be injected using pumping techniques, which are known in the art.

Once the composite beams 11 are in place and the compression reinforcement 31 has been introduced, the deck slab 21 may cast in place on the tops of the composite beams 11. In one embodiment, the deck slab 21 is a seven-inch thick reinforced concrete slab. The deck slab 21 can also be constructed using different composition and/or different materials.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Although the invention has been described in detail with reference to certain illustrative embodiments, variations and modifications exist within the scope and spirit of the invention as described and as defined in the claims. Even though only a limited number of embodiments have been described, it will be apparent to those of ordinary skill in the art that many more embodiments and implementations are possible that are within the scope of this invention. Accordingly, the invention is not to be restricted except in light of the attached claims and their equivalents.

The invention claimed is:

1. A construction beam comprising:

an elongated shell that has an interior volume; a curved conduit within the interior volume of the shell, wherein the curved conduit has a tubular cross section and has a curved profile extending along a longitudinal direction of the construction beam; an auxiliary conduit within the interior volume of the shell, wherein the auxiliary conduit extends along a lateral direction of the beam; and a compression reinforcement that fills the interior volume of the curved conduit and the auxiliary conduit, wherein the compression reinforcement comprises a concrete material; wherein the profile of the curved conduit follows a generally parabolic path; wherein the compression reinforcement contributes directly to the strength of the construction beam; and wherein the curved conduit and the auxiliary conduit are in fluid communication with one another.

2. The construction beam of claim 1, wherein the compression reinforcement is inserted into the conduit after the construction beam is erected.

3. The construction beam of claim 1, wherein auxiliary conduit extends outwardly from the curved conduit through the shell.

4. The construction beam of claim 1,further comprising a shear connection device comprising a body having a first end and a second end, wherein the first end of the body is positioned in the curved conduit and the second end of the body extends through the auxiliary conduit.

5. The construction beam of claim 1,further comprising a shear connection device comprising a body having first end and a second end, wherein the first end of the body is positioned in the compression reinforcement and the second end of the body extends through the shell.

6. The construction beam of claim 5, wherein the shear connection device comprises an anchoring device coupled to the second end of the body.

7. The construction beam of claim 5, wherein the second end of the body extends outwardly into a supported slab, resulting in composite behavior between the beam and the slab.

8. The construction beam of claim 5, wherein the elongated shell comprises a top flange, and the shear connection device comprises a plurality of shear connection devices, and wherein each shear connection device is installed at an angle relative to the top flange that is a function of a distance between the shear connection device and a first end of the elongated shell.

9. The construction beam of claim 5, wherein the elongated shell comprises a top flange, and the shear connection device comprises a plurality of shear connection devices, and wherein each shear connection device is installed at an angle relative to the top flange that is a function of a shear force within the construction beam at a location of the shear connection device.

* * * * *